US006299491B1

(12) United States Patent
Bruce

(10) Patent No.: US 6,299,491 B1
(45) **Date of Patent: *Oct. 9, 2001**

(54) RF CONNECTOR CLIP RING

(75) Inventor: Burton B. Bruce, New Hartford, CT (US)

(73) Assignee: Litton Systems, Inc., Woodland Hills, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/337,180

(22) Filed: Jun. 21, 1999

(51) Int. Cl.[7] ..... H01R 11/22
(52) U.S. Cl. ..... 439/745; 439/744; 439/851
(58) Field of Search ..... 439/744, 745, 439/932, 869, 851, 852

(56) References Cited

U.S. PATENT DOCUMENTS

| | | | | |
|---|---|---|---|---|
| 3,040,287 | * | 6/1962 | Agron et al. | 439/745 |
| 3,144,292 | * | 8/1964 | Forney, Jr. | 439/745 |
| 3,229,244 | * | 1/1966 | Bachman | 439/744 |
| 3,475,720 | * | 10/1969 | Culver | 439/744 |
| 4,413,875 | * | 11/1983 | Mattingly | 439/733.1 |
| 4,701,607 | * | 10/1987 | Yohn | 439/744 |
| 5,041,020 | * | 8/1991 | Michael | 439/578 |
| 5,588,852 | * | 12/1996 | Puerner | 439/851 |

* cited by examiner

*Primary Examiner*—Hien Vu
(74) *Attorney, Agent, or Firm*—Lowe Hauptman Gilman & Berner, LLP

(57) ABSTRACT

A clip ring for securing a contact pin in a connector cavity is circumferentially compressible as in prior art clip ring, but includes several beam fingers projecting radially and obliquely outward against the walls of the cavity for a more secure and more stable position of the pin.

4 Claims, 2 Drawing Sheets

PRIOR ART
FIG. 1
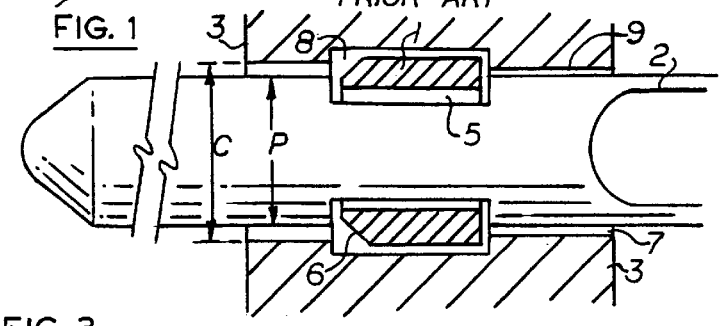
FIG. 2
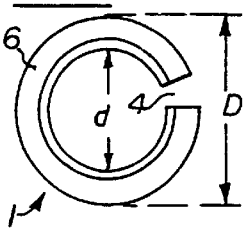
FIG. 3
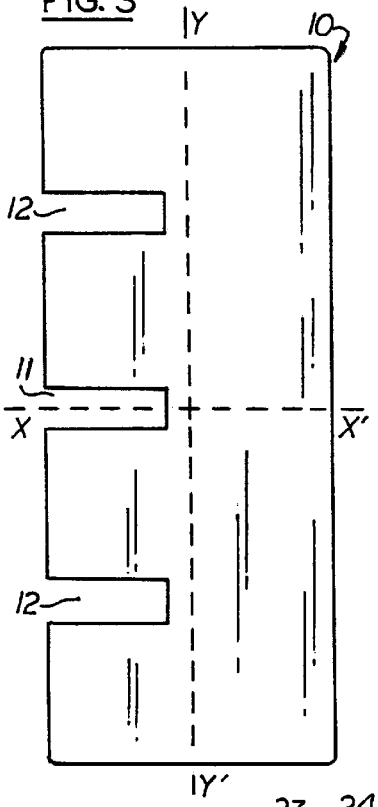
FIG. 4
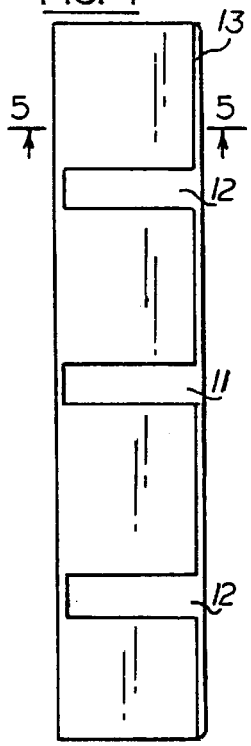
FIG. 5
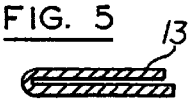
FIG. 6
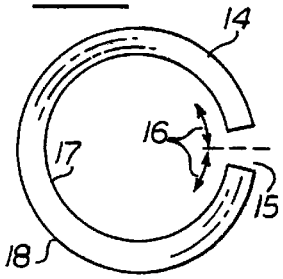
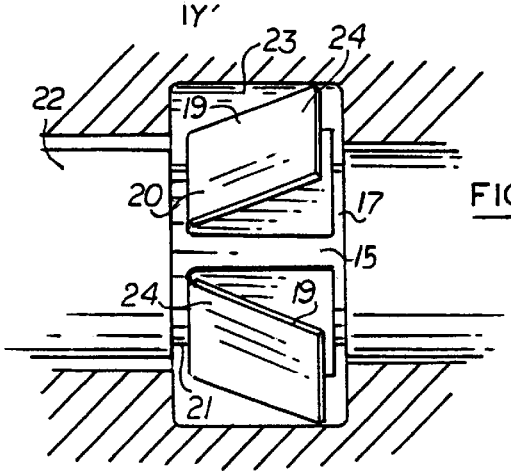
FIG. 7

RF CONNECTOR CLIP RING

FIELD OF THE INVENTION

This invention relates to clip rings commonly used for securing a cylindrical component in a bearing or other cavity, and more particularly to clip rings that are used for securing a contact pin in an electrical connector cavity.

BACKGROUND OF THE INVENTION

Clip rings are commonly used to removably secure shafts and similar structures in bearing and other cylindrical cavities.

Typically, the clip ring made of steel or other resilient material forms an open loop that can be captured in a circular depression along a shaft. The ring is circumferentially compressed to a point where the gap in the loop of the ring is nearly closed, and the entire ring is completely nested in the circular depression of the shaft. The shaft is then inserted into a cylindrical bearing that has a circular groove commensurate with the ring. When the ring reaches the groove, it circumferentially expands to a degree sufficient to enter the groove without completely leaving the circular depression of the shaft. The shaft is thus axially immobilized into the bearing.

In some single or multi-conductor electrical connectors, the terminal pins must be accurately positioned and oriented to precisely and intimately engage the corresponding terminals of the mating connector. Yet, it is desirable that each pin be removable for attachment by crimping or soldering to a conductor, or for reassignment of a lead to a different position within the same connector. Due to the extreme miniaturization of certain modern multi-conductor connectors, it is practically impossible to solder or crimp a wire to a terminal pin while it is mounted on the connector body.

As exemplified in the prior art structure illustrated in FIGS. 1 and 2, a clip ring 1 is used to mount a terminal pin 2 in the body 3 of a single or multi-conductor connector. In its normal state, the clip ring 1 has a circumferential gap 4 and an outer diameter D which exceeds the outer diameter P of the terminal pin 2, which outer diameter is, in turn, larger than the inner diameter d of the ring. The ring is circumferentially expanded to engage upon, and slide along the terminal pin body until it snaps into a circular depression 5. The front end of the ring has a beveled area 6. which circumferentially compresses the ring into the depression 5 when the pin is pushed into its circular holding channel 7 whose diameter C is slightly larger than the diameter P of the terminal pin.

When the ring reaches a circular groove 8 in that channel, it circumferentially expands to its normal size, thus locking the pin into the connector body 3.

The terminal pin can only be removed by means of a tubular tool, not shown on the drawing. That tool has a thickness no greater than the difference between the diameter C of the holding channel and that P of the terminal pin. The tool acts upon the beveled front area 6 of the clip ring to compress it back into the depression 5, so that the terminal pin can be extracted.

The difference in the terminal pin and holding channel diameters, coupled with the fact that once expanded into the circular groove, the ring does not tightly contact the terminal pin, creates a certain degree of instability and misalignment. This makes it difficult to insert the connector into its mating structure without a great deal of wiggling maneuvers.

The problem can only be partially palliated by providing a tighter fit between the pin and the back section 9 of the holding channel that does not need to be penetrated by the removing tool.

If the clip ring and connector bodies are not manufactured to exacting tolerances, the clip ring can slip away from its circular groove when axial pressure is applied to the pin. This problem tends to particularly affect certain miniature connectors.

This invention results from an attempt to find a solution to the aforesaid shortcomings of the prior art electrical connectors.

SUMMARY OF THE INVENTION

The principal and secondary objects of this invention are to provide a clip ring for securing a shaft, pin, or other similar parts into a circular channel in a removable, yet reliably stable, manner while using relatively broad manufacturing tolerances; and more specifically, to provide a clip ring that has both a compressibly variable circumference as well as compressibly variable thickness.

These and other valuable objects are achieved by a clip ring that combines a resiliently compressible cicular body and obliquely and outwardly projecting resilient fins. In a first embodiment of the invention, the ring has a first inner tubular layer, and an outer peripheral layer having obliquely and outwardly bent resilient projections. This type of clip ring is particularly adapted for removably mounting terminal pins in miniature electrical connectors.

BRIEF DESCRIPTION OF THE DRAWING

FIG. 1 is a cross-sectional view of a connector pin attachment of the prior art;

FIG. 2 is a front elevational view of a clip ring of the prior art;

FIG. 3 is a top plan view of a sheet metal portion used to manufacture the improved clip ring;

FIG. 4 is a top plan view of that folded portion;

FIG. 5 is a cross-sectional view taken along line 5—5 of FIG. 4;

FIG. 6 is a front elevational view of the novel clip ring prior to finger deployment;

FIG. 7 is a side elevational view of the finished novel clip ring installed in a connector cavity;

DESCRIPTION OF THE PREFERRED EMBODIMENTS OF THE INVENTION

These preferred embodiments of the clip ring are specifically designed to be mounted on a contact pin for a so-called D-type subminiature coaxial connector, which pin has an outer diameter in the order of approximately 3.8 millimeters (0.15 inch).

Figure 8:
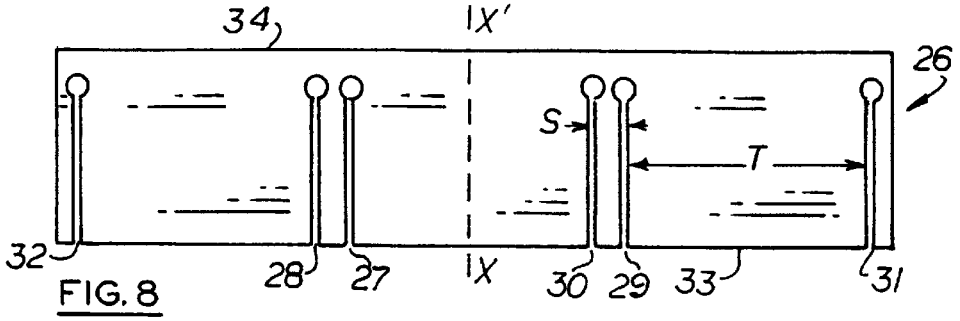
FIG. 8 is a top plan view of a sheet metal portion used to manufacture an alternate embodiment of the clip ring.
Figure 9:
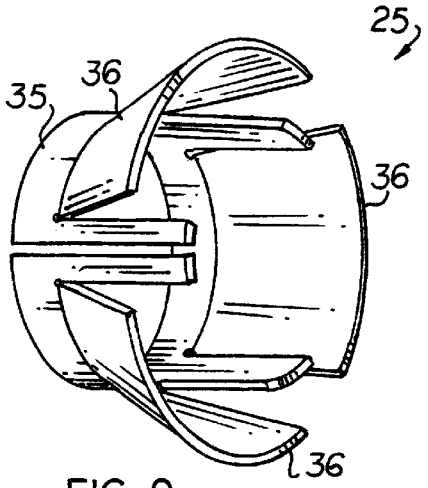
FIG. 9 is a perspective view of said alternate embodiment.
Figure 10:
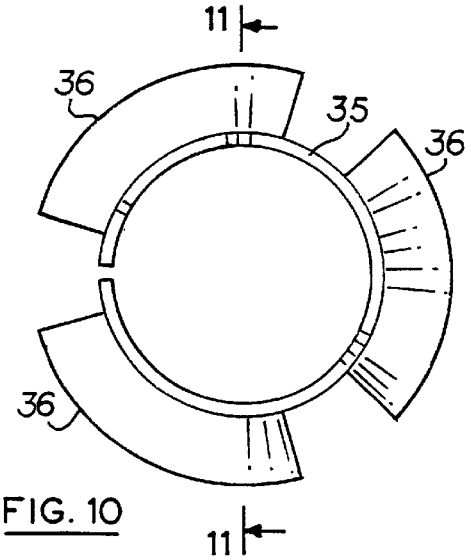
FIG. 10 is a front elevational view thereof.
Figure 11:
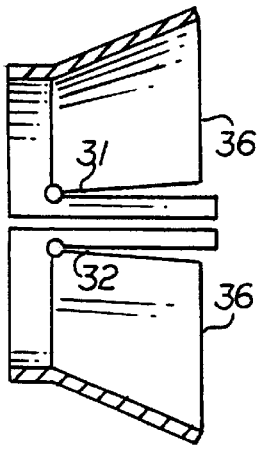
FIG. 11 is a cross-sectional view taken along line 11—11 of FIG. 10.

Referring now to FIGS. 3–11 of the drawing, the manufacture and structure of the preferred embodiments of the improved clip ring will now be described. In a first embodiment, illustrated in FIGS. 1–7, the entire clip ring is manufactured from a quadrangular sheet metal section 10 of stainless steel or beryllium-copper alloy with approximate dimensions of 1.2 centimeters in length (0.47 inches), 0.5 centimeters in width (0.2 inch), and a thickness of 0.2 millimeters (0.008 inch). A first indentation 11 is cut along one longitudinal side of the section 10 in alignment with the median latitudinal axis X-X'. The indentation extends nearly to the median longitudial axis Y-Y'. Two additional indentations 12 with symmetrical widths and parallel to the first indentation 11 are also cut about 0.3 centimeters (0.13 inch) on either side of the first indentation 11 as illustrated in FIG. 3.

The section 10 of stainless steel is folded about its longitudinal median axis Y-Y' as shown in FIGS. 4 and 5. The resulting structure 13 is then longitudinally and permanently bent into a near tubular shape 14 leaving a gap 15 of approximately 20 degrees. At this point, the structure resembles a conventional clip ring with a circumferential resiliency illustrated by arrows 16.

The clip ring is distinguished from the prior art by the fact that it now includes an inner ring layer 17 and a concentric, discontinuous outer ring layer 18 joined at a front end. The distinct segments 19 of the outer ring layer 18 which are delineated by the indentations 11–12 and the gap 15 are then bent obliquely and permanently outwardly to an angle of approximately 20 degrees to form flaring and resiliently compressible fingers or fins 24.

As illustrated in FIG. 7, when such a clip ring 20 mounted in a circular depression 21 of a pin or shaft 22 encounters a commensurate circular groove 23 practiced in a circular channel having the diameter slightly larger than the diameter of the pin or shaft, the circumferencially and radially compressed ring expands and the fingers 24 project into the circular groove 23 to provide a firm and stable immobilization of the shaft or pin. In other words, the movement of the fingers 24 provide a resilient augmentation of the ring thickness that combines with the circumferential resiliency of the ring about gap 15 to greatly augment the overall expansion of the ring and consequently allow more liberal tolerance in its fabrication.

In the alternate embodiment of the invention illustrated in FIGS. 8–11, the clip ring 25 is manufactured from a quadrangular sheet metal section 26 of stainless steel or beryllium-copper alloy with approximate dimensions of 1.08 centimeters in length (0.425 inches), 0.25 centimeters in width (0.1 inch), and a thickness of 0.2 millimeters (0.008 inch). Pairs of parallel indentations 27–32 are cut along one longitudinal side 33 of the section 26 astride the median latitudinal axis X-X'. Indentations within a pair are separated by a distance S of about 0.5 millimeters (0.02 inches); and a distance T of 3.5 millimeters (0.14 inches) separates adjacent pairs of indentations. The indentations extend to within 0.5 millimeters (0.02 inch) of the opposite longitudinal side 34.

The section 26 of metal is permanently bent into a near tubular shape leaving a gap 35 of approximately 3 degrees. At this point, the structure resembles a conventional clip ring with some circumferential resiliency.

The distinct largest segments 36 which are delineated by the indentations are then bent obliquely and permanently outwardly to an angle of approximately 20 degrees to/from flaring and resiliently compressible fingers or fins similar in shape and function to those of the first described embodiment.

While the preferred embodiments of the invention have been described, modifications can be made and other embodiments may be devised without departing from the spirit of the invention and the scope of the appended claims.

What is claimed is:

1. A circular clip for an electrical contact to be secured to an electrical conductor having an inwardly extending annular groove within a cavity, the electrical contact having an outwardly extending annular groove, said circular clip comprising:

a metal body including an annular strip having an inner ring layer and an outer ring layer, said inner layer and said outer layer having a substantially equally size and being joined at a front end of said body, a plurality of resiliently and compressibly movable fingers projecting obliquely and radially from said outer ring layer, said body being bent at approximately at mid-point of said inner layer and outer layer to form said annular strip having a gap between ends thereof, wherein said annular strip is positionable against inwardly extending annular groove of the electrical conductor and said fingers are to be brought into engagement with the outwardly extending annular groove of said cavity.

2. The clip of claim 1, wherein said metal clip is formed of a resiliently flexible material.

3. The clip of claim 2, wherein said metal is taken from a group consisting essentially of stainless steel, and beryllium copper alloy.

4. A connector having at least one connecting terminal, the connector having an outwardly extending groove and the terminal having an inwardly extending annular groove, the connector comprising:

a metal body including an annular ring connected to a plurality of resiliently, radially compressible fins projecting obliquely and coaxially outwards from said ring, said body being bent at approximately at a mid-point of said inner layer and outer layer to form said annular strip and said fins;

wherein said annular ring is positionable against said inwardly extending annular groove of said terminal and said fins are brought into engagement with said outwardly extending annular groove;

said body is formed of quadrangular strip of metal having a longitudinal axis, a latitudinal axis, and a given width, said strip being folded about said longitudinal axis to form a two-layer body having approximately half of said width;

said body being bent into a nearly closed circular shape to form said ring and having an inner layer and an outer layer joined at a front end of said inner layer, and concentric with said inner layer;

said outer layer having a plurality of axially directed indentations, and a plurality of segments separating said indentations, wherein said segments are spread radially in an oblique and backward direction in relation to said front end to form said fins.

* * * * *